United States Patent [19]

Fujii

[11] 3,948,738

[45] Apr. 6, 1976

[54] PROCESS FOR THE REGENERATION OF EXHAUSTED CHROMIUM-PLATING SOLUTIONS BY TWO-STAGE DIAPHRAGM ELECTROLYSIS

[75] Inventor: Akira Fujii, Kawasaki, Japan

[73] Assignee: Kabushiki Kaisha Fuji Kuromu Sha, Yokohama, Japan

[22] Filed: Jan. 29, 1974

[21] Appl. No.: 438,146

[52] U.S. Cl. ..... 204/151; 204/89; 204/96; 204/112; 204/130; 204/180 P

[51] Int. Cl.[2] ..... C25B 1/00; C25C 1/06

[58] Field of Search.... 204/130, 151, 89, 96, 180 P, 204/106, 107, 108, 112

[56] References Cited

UNITED STATES PATENTS

| | | | |
|---|---|---|---|
| 3,595,765 | 7/1971 | Joo | 204/89 |
| 3,761,369 | 9/1973 | Tirrell | 204/130 X |

*Primary Examiner*—Howard S. Williams
*Assistant Examiner*—A. C. Prescott
*Attorney, Agent, or Firm*—Burgess, Dinklage & Sprung

[57] ABSTRACT

Regeneration of an exhausted chromium-plating solution can be effectively effected by two-stage diaphragm electrolysis. For the first electrolysis, the anode compartment is charged with a diluted aqueous chromic acid solution and the cathode compartment is charged with an exhausted chromium-plating solution. After the first electrolysis, the solution obtained in the cathode compartment is transferred into the anode compartment which has been emptied by withdrawing the electrolytic solution obtained by the first electrolysis, and the cathode compartment is charged with an exhausted chromium-plating solution. Then, the second electrolysis is conducted. When each electrolysis is finished, regenerated solution useful as a chromium-plating solution is obtained. Some modifications are effective not only for regeneration of an exhausted chromium-plating solution but also for prevention of environmental pollution.

5 Claims, No Drawings

PROCESS FOR THE REGENERATION OF EXHAUSTED CHROMIUM-PLATING SOLUTIONS BY TWO-STAGE DIAPHRAGM ELECTROLYSIS

This invention relates to a process for treating chromium-plating waste liquor, and more particularly to a process for the regeneration of exhausted chromium-plating solutions by diaphragm electrolysis.

When a chromium-plating bath is used for a long period of time, there is increased gradually the iron values in the bath because of iron dissolving into the plating bath due to the inverse current treatment of the iron or steel which is to be subjected to a plating operation and due to the occasional use of an iron anode, and also there is an increase of trivalent chromium in the plating bath. Accordingly various difficulties such as elevation of electrolytic voltage, degradation of uniformity of plating, increase of pin holes, poor adhesion of plating coat, etc. are encountered. Thus, such used plating bath can not be employed as a chromium-plating bath any longer in spite of a considerable amount of chromic acid contained therein, but becomes noxious waste liquor or an exhausted plating solution. The discharge of this exhausted plating solution not only results in a loss of effective chromic acid but also will result in pollution of the ocean, rivers and vacant ground, if discharged without suitable treatment.

With regard to the previous processes for treating exhausted chromium-plating solution, it has conventionally been proposed to reduce chromic acid (containing hexavalent chromium) and neutralize it to form a solid sludge of trivalent chromium hydroxide. The process has the disadvantage that there is also difficulty in treating this sludge and besides, the process requires large quantities of the reducing and neutralizing agents for treating the exhausted chromium-plating solution of high chromic acid concentration as opposed to the case in which there is treated a chromic acid solution of low concentration such as the diluted waste water resulting from washing freshly plated products. There has further been proposed a diaphragm electrolytic process for removing the iron values from the exhausted chromium-plating solution in the anode compartment through a diaphragm into the cathode compartment (German Auslegeschrift No. 2216393). However, such diaphragm electrolytic process is not satisfactory in view of its poor efficiency. On the other hand, the known process of recovering chromic acid using an ion exchange resin is also not applicable to the exhausted chromium-plating solution of higher chromic acid concentration because the life and ion exchange capacity of ion exchange resins are insufficient. Furthermore, I have previously proposed a process for the regeneration of an exhausted chromium-plating solution which comprises admixing an exhausted chromium-plating solution with chromium hydroxide to convert all the chromium values in the exhausted chromium-plating solution into water-soluble chromium chromate complex including trivalent and hexavalent chromium ions and simultaneously to precipitate the iron values contained in the exhausted solution in the form of iron hydroxide, firing at a lower temperature the iron hydroxide obtained as the residue of a filtration to convert it into non-toxic waste iron oxide and, on the other hand, oxidizing electrolytically the aqueous chromium chromate complex solution obtained as filtrate in the anode compartment of a diaphragm electrolytic cell to obtain chromic acid, which is then reused as the principal component of a chromium-plating bath (German Auslegeschrift No. 2216393). According to the abovementioned process the chromium hydroxide obtained by the reducing and neutralizing treatment of diluted chromium-plating waste liquor formed in the washing of chromium-plated products is advantageously reusable thereby avoiding its discharge with concommitant environmental pollution. However, in the abovementioned process, chromium hydroxide is obtained only in a relatively small quantity. For this reason, when the abovementioned process is practised, it is necessary to purchase chromium hydroxide, leading to great increase in treatment cost.

It is accordingly an object of the invention to overcome the difficulties and defects involved in the conventional process for treating an exhausted chromium-plating solution and obtain an advantageous process for the treatment of an exhausted chromium-plating solution.

Another object of the present invention is to provide a process for effectively treating an exhausted chromium-plating solution using easily available materials.

Another object of the present invention is to provide a process for treating an exhausted chromium-plating solution using the sludge obtained from the reduction and neutralization of diluted chromium-plating waste liquor obtained by the washing of chromium-plated products.

A further object of the present invention is to provide a process as mentioned above, which can be easily conducted at low cost.

The foregoing and other objects, features and advantages will be understood from the following detailed description and appended claims.

Essentially, according to the present invention, there is provided a process for treating an exhausted chromium-plating solution by two-stage diaphragm electrolysis, comprising the steps of conducting a first electrolysis in a diaphragm electrolytic cell partitioned by a diaphragm into an anode compartment containing a diluted aqueous chromic acid solution and a cathode compartment containing an exhausted chromium-plating solution; interrupting said first electrolysis when the chromic acid concentration in the anode compartment reaches a predetermined level due to the transfer and extraction of the chromic acid values in the cathode compartment into the anode compartment by the electrodialysis; withdrawing for use as a chromium-plating bath the solution obtained in the anode compartment; transferring the obtained solution in said cathode compartment into said anode compartment; charging said cathode compartment with an exhausted chromium plating solution; and conducting a second electrolysis to effect an electrolytic oxidation in said anode compartment and to effect the electrodialysis of the chromic acid values in said cathode compartment to transfer and extract the chromic acid values into said anode compartment, thereby increasing the chromic acid concentration in said anode compartment to a predetermined level.

The term "exhausted chromium-plating solution" has reference to a used chromium-plating solution in which the amounts of iron and trivalent chromium dissolved therein increases exessively during the service of chromium-plating solution. Such exhausted chromium-plating solution can not be used as a chromium-plating bath because of the excessively high content of iron and trivalent chromium dissolved in the solution, despite the fact that in the solution there is still contained chromic acid in a considerable amount or in an amount sufficient for chromium-plating (150 – 250 g. $CrO_3$/liter). Therefore, it should be understood that by the regeneration of exhausted chromium-plating solution it is meant that the excessive amount of dissolved iron is removed from the exhausted chromium-plating solution, the trivalent chromium values are oxidized to chromic acid effective for chromium-plating and the chromic acid concentration in the solution is adjusted to 150 – 250 g./liter to obtain a solution utilizable as a chromium plating bath.

According to the present invention, in the first electrolysis the chromic acid contained in exhausted chromium-plating solution in the cathode compartment is transferred and extracted gradually through the diaphragm into the anode compartment under the effect of electrodialysis to raise the chromic acid concentration in the anode compartment as the electrolysis proceeds. Accordingly the chromic acid concentration in the cathode compartment decreases, while the electrolytic reduction proceeds to convert chromic acid partially to chromium chromate, thus increasing the trivalent chromium content and finally the dissolved iron contained therein is precipitated on the surface of the cathode plate. As regards the state of precipitated iron compound, iron hydroxide is converted to reddish brown, very dense ferric oxide ($Fe_2O_3$) so compact as to be easily filterable. In this instance, the cathodic plate is partially plated with chromium, which causes no trouble. If it is desired to avoid this, the deposit may be controlled by regulating the condition of electrolysis or by using a carbon electrode.

As regards the content of dissolved iron in the chromium-plating solution capable of chromium-plating, a solution containing 5 g./liter or less of iron is usable for chromium-plating. It is noted in this regard that although a plating solution containing no dissolved iron is of course usable, the plating solution containing 2 – 5 g./liter of dissolved iron is preferable for chromium-plating.

In the manner as stated, the chromic acid concentration is the anode compartment is raised to deposit iron in the cathode compartment. The first-stage electrolysis is then interrupted. The determination of the end point of said electrolysis is done by taking the following into consideration: The most preferable and practical end point of the first electrolysis is the time when the chromium values in the anode compartment falls within 150 – 250 g./liter while the dissolved iron in the cathode compartment is at the level of 2 – 5 g./liter. When the chromic acid concentration is in the anode compartment reaches 250 g./liter but the iron concentration in the cathode compartment still exceeds 5 g./liter, either one of two methods is employable. One method is that the first electrolysis is interrupted and the solution obtained in the anode compartment is directly used as a chromium-plating bath while the solution in the cathode compartment is diluted with water, at the time of transferring the solution of the cathode compartment into the anode compartment, so that the iron concentration may be 2 – 5 g./liter. The other method is to continue the first electrolysis till the iron concentration of the solution in the cathode compartment comes to less than about 5 g./liter, interrupt the first electrolysis, dilute the concentrated chromic acid solution obtained in the anode compartment with water to a chromic acid concentration of 150 – 250 g./liter to be utilized as a chromium-plating bath, and transfer the solution in the cathode compartment directly into the anode compartment for the second electrolysis. In either case, the first electrolysis must be continued till the chromic acid concentration of the solution in the anode compartment comes up to the range of 150 – 250 g./liter liter which is applicable for a chromium-plating bath.

The concentration of the diluted aqueous chromic acid solution to be used in the anode compartment in the first electrolysis is not critical as far as the chromic acid concentration is below 150 – 250 g./liter. Generally, a diluted solution having a chromic acid concentration of 30 – 120 is preferablly employed.

Next, in respect of the second electrolysis, the supernatant or filtrate of the solution in the cathode conpartment, after the first electrolysis, is transferred to the anode compartment which has previously been emptied after completion of the first electrolysis, and then the thus emptied cathode compartment is again charged with an exhausted chromium-plating solution, followed by the second electrolysis. In the second electrolysis, highly concentrated chromium chromate, namely trivalent chromium values in the anode compartment which were produced in the cathode compartment during the first electrolysis, is anodically oxidized to be rapidly and entirely converted to chromic acid of hexavalent chromium. In addition, according to the same mechanism as that described relative to the first electrolysis the chromic acid values of the exhausted chromium-plating solution in the cathode compartment are transferred into the anode compartment to enhance the concentration of chromic acid in the anode compartment. Similarly to the first electrolysis, the second electrolysis is interrupted when the chromic acid concentration in the anode compartment reaches a predetermined value, and the solution in the anode compartment is withdrawn and utilized, directly or after dilution, as a chromium-plating solution.

The first and second electrolytic operations may be conducted preferably at a low voltage, for example, 10 V and a current density of 0.5 – 2 A/liter.

It is, of course, possible that the diaphragm electrolytic process of this invention is repeated to effect regeneration of an exhausted chromium-plating solution successively.

According to another embodiment of the present invention, there is provided a process for treating an exhausted chromium-plating solution by two-stage diaphragm electrolysis, comprising the steps of conducting a first electrolysis in a diaphragm electrolytic cell partitioned by a diaphragm into an anode compartment containing a diluted aqueous solution of exhausted chromium-plating solution obtained by diluting an exhausted-plating solution with water and a cathode compartment containing an exhausted chromium-plating solution; interrupting said first electrolysis when the chromic acid concentration in the anode compartment reaches a predetermined level due to the transfer and extraction of the chromic acid values in the cathode compartment into the anode compartment by the electrodialysis; withdrawing for use as a chromium-plating bath the solution obtained in the anode compartment; transferring the obtained solution in said cathode compartment into said anode compartment; charging said cathode compartment with an exhausted chromium plating solution; and conducting a second electrolysis to effect electrolytic oxidation in said anode compartment and to effect the electrodialysis of of the chromic acid values in said cathode compartment to transfer and extract the chromic acid values into said anode compartment, thereby increasing the chromic acid concentration in said anode compartment to a predetermined level.

This process is the same as the preceding one except that the anode compartment in the first electrolysis is charged with a diluted aqueous solution of exhausted chromium-plating solution in place of a diluted aqueous chromic acid solution. The degree of dilution of exhausted chromium-plating solution depends on the amount of the iron values dissolved therein. Illustratively stated, the iron content of the solution usable as a chromium-plating solution is about 5 g./liter or less as mentioned hereinbefore, and a small amount of iron values transferred from the anode compartment to the cathode compartment is expected in the first electrolysis. Generally, it is preferable to employ such a dilution degree that the iron content of the resulting solution may be below about 5 g./liter. The first electrolysis is conducted in the same manner as described in connection with the preceding embodiment, with the anode compartment charged with a diluted aqueous solution of exhausted chromium-plating solution and with the cathode compartment charged with an exhausted chromium-plating solution as such.

The two-stage diaphragm electrolysis proceeds according to the same mechanism as described in detail with respect to the first embodiment with the exception that the trivalent chromium contained in the solution of the anode compartment is rapidly converted to chromic acid of hexavalent chromium by the anodic oxidation. Illustratively stated, with progress of the electrolysis, the chromic acid concentration in the solution of the anode compartment is increased due to the transfer of the chromic acid values from the cathode compartment into the anode compartment; the chromium chromate complex is formed in the cathode compartment and the iron values in the cathode compartment are caused to precipitate simultaneously therewith. When each of the first and second electrolytic stages has been finished, the solution, which has little content of dissolved iron but enough concentration of chromic acid, useful as a chromium-plating bath is regenerated and recovered in the anode compartment.

Exemplification of the above-mentioned process is now given. When an exhausted chromium-plating solution containing dissolved iron values of 15 g./liter is diluted with water to a volume 5 times as much, the obtained diluted solution has an iron concentration of 3 g./liter. This content of iron is further reduced during the first-stage electrolysis in which the iron values are transferred from the anode compartment into the cathode compartment. As a result, the iron content of the solution in the anode compartment comes to below 3 g./liter. This level of iron content is satisfactory for a solution to be employed as a chromium-plating bath. If the chromic acid content of the exhausted chromium-plating solution is 200 g./liter in terms of chromic anhydride, it becomes 40 g./liter in terms of chromic anhydride after the dilution.

On the other hand, as the cathode compartment is charged with an exhausted chromium-plating solution as such, the chromic acid concentration of the solution is 200 g. $CrO_3$/liter and the iron concentration is 15 g./liter in the cathode compartment. The first electrolysis is started using a lead anode plate and an iron or carbon cathode plate at a D. C. voltage as low as 10 V with a current density of 0.5 – 2 A/liter. As the electrolysis proceeds, the chromic acid concentration of the solution in the anode compartment gradually increases from 40 g. $CrO_3$/liter to a concentration as high as more than 200 g. $CrO_3$/liter which is high enough to use as a chromium-plating bath. In the cathode compartment, in addition to the decrease of chromic acid values due to its transfer through diaphragms, it is observed that the increase of trivalent chromium concentration in the form of chromium chromate complex by electrolytic reduction finally reaches a level as high as 30 g./liter and at this time the contained iron values begin to precipitate on the surface of the cathode plate so that the iron values in the solution within the acidic range are reduced to a level as low as 1 – 2 g./liter. At the time when the iron values are reduced to such low level, the first electrolysis is interrupted. The solution obtained in the anode compartment is recovered and used as a chromium-plating solution, and the supernatant or filtrate of the solution in the cathode compartment obtained after the first electrolysis is transferred to the anode compartment which has been emptied. The cathode compartment is then charged with an exhausted chromium-plating solution as such, and the second electrolysis is conducted. The electrolysis proceeds according to the same mechanism as described before so that the chromic acid concentration of the solution in the anode compartment gradually increases, finally to more than 200 g. $CrO_3$/liter. The resulting solution is recovered and used as a chromium-plating bath. If the process of second electrolysis is repeated, fresh chromium-plating solutions can be successively regenerated from exhausted chromium-plating solutions.

According to a further embodiment of the present invention, there is provided the improvement in the aforementioned processes for treating an exhausted chromium-plating solution by the two-stage diaphragm electrolysis, wherein an aqueous chromium-chromate complex solution which is free of iron value and is obtained by a complete reaction between an exhausted chromium-plating solution and a sludge which includes mainly chromium hydroxide and is obtained by reducing and neutralizing a diluted chromium-plating waste liquor is added to the solution in the anode compartment for the first electrolysis and/or the second electrolysis; and a reaction mixture which includes chromium chromate complex and iron values and is obtained by an incomplete reaction between an exhausted chromium-plating solution and a sludge which includes mainly chromium hydroxide and is obtained by reducing and neutralizing a diluted chromium-plating waste liquor is added to the solution in the cathode compartment for the first electrolysis and/or the second electrolysis.

In addition to the treatment of an exhausted chromium-plating solution there is another problem in the chromium-plating factory in that the diluted chromium-plating waste liquor which results from the wash water and bath leaks is also necessarily treated.

Such waste liquor has a chromic acid concentration lower than that of the exhausted chromium-plating solution, but it cannot be, as such, discharged in vacant places or waters lest it result in environmental pollution. There has long been a great demand in the art for a method of effectively treating such waste liquor.

An effective method for treating the mentioned diluted chromium-pleating waste liquor will be obtained if either of the aforementioned processes for treating an exhausted chromium-plating solution by the two-stage diaphragm electrolysis is combined with an ingenious operation. This may be realized as follows: As set forth before, when a diluted chromium-plating waste liquor is reduced and neutralized according to the customary method there is obtained a sludge chiefly composed of chromium (III) hydroxide. When the sludge obtained is completely reacted with an exhausted chromium-plating bath, all the chromium values contained therein are converted into the water-soluble chromium chromate complex while the iron values precipitate in the form of iron hydroxide. When the thus obtained aqueous chromium chromate solution is added to the solution in the anode compartment for the first and/or second electrolysis and electrolysis is conducted, all the chromium values contained therein are converted to chromic acid whereby a fresh chromium-plating solution can advantageously be obtained. Meanwhile, when the exhausted chromium-plating solution is incompletely reacted with the sludge due to shortage of the sludge or other causes, there will be obtained a reaction mixture containing, beside chromium chromate complex, considerable quantities of chromic acid and iron values. When the thus obtained reaction mixture is added to the solution in the cathode compartment for the first and/or second electrolysis and electrolysis is conducted, the chromic acid values contained therein are transferred into the anode compartment to enhance the chromic acid concentration in the anode compartment and the rest of chromic acid is converted to chromium chromate complex in the cathode compartment. At the same time, the iron values are precipitated, in the cathode compartment, as iron hydroxide which is finally converted to a very dense ferric oxide. The solution thus obtained in the cathode compartment is utilizable as an electrolytic solution for an anode compartment in the subsequent electrolysis. In such manner the diluted chromium-plating waste liquor can be effectively introduced in the process for treating an exhausted chromium-plating solution so that the chromium values other than that to be plated in the chromium-plating factory may be all utilized for the regeneration of a chromium-plating solution in a completely closed system. Thus, the present process is extremely useful not only for effective regeneration of a chromium-plating solution but for prevention of environmental pollution.

The following examples are given to illustrate the present invention in detail.

EXAMPLE 1

Employed is a 0.5 ton type diaphragm electrolytic cell having a diaphragm made of polyvinyl chloride. 500 liters of an equeous chromic acid solution having a chromic anhydride concentration of 100 g./liter and a sulfuric acid concentration of 1 g./liter are introduced in the anode compartment, and 500 liters of an exhausted chromium-plating solution (containing 250 g./liter of anhydride, 15 g./liter of iron, 2.5 g./liter of sulfuric acid and 10 g./liter of trivalent chromium) are introduced in the cathode compartment. The first electrolysis is conducted at D.C. voltage of 10 V. and a current density of 500 mA/liter for 150 hours. When the first electrolysis is finished, the resulting solution in the anode compartment is an aqueous chromic acid solution having a chromic anhydride content of 200 g./liter. The solution is adjusted to have a normal trivalent chromium content. The chromium-plating test reveals a satisfactory result. Then, the supernatant of the resulting solution in the cathode compartment is transferred into the anode compartment, while the cathode compartment is charged with an exhausted chromium-plating solution having the same composition as mentioned above. The second electrolysis is conducted for 180 hours under the same conditions as mentioned above. The solution obtained in the anode compartment is adjusted in respect of the trivalent chromium content and tested in respect of performance in chromium-plating. Excellent plating is obtained similar to that obtained by employing a fresh plating bath.

EXAMPLE 2

Employed is the same diaphragm electrolytic cell as in Example 1. 500 liters of the same exhausted chromium-plating solution as employed in Example 1 are introduced in the anode compartment, and 500 liters of the quintuple diluted aqueous solution (containing 50 g./liter of chromic anhydride, 3 g./liter of iron, 0.5 g./liter of sulfuric acid and 2 g./liter of trivalent chromium) of the same exhausted chromium-plating solution as mentioned above is introduced in the cathode compartment. The first electrolysis is conducted under the same conditions as described in Example 1 for 180 hours. The solution obtained in the anode compartment contains 200 g./liter of chromic anhydride and 2.6 g./liter of iron but no trivalent chromium is detected in the solution. In the second electrolysis, 400 liters of the supernatant of the solution obtained in the cathode compartment after the first electrolysis are transferred into the anode compartment in which there have remained into the anode compartment in which there have remained 100 liters of the solution obtained by the first electrolysis. The thus prepared solution in the anode compartment contains 70 g./liter of chromic anhydride, 25 g./liter of trivalent chromium and 2.6 g./liter of iron. 500 liters of the same exhausted chromium-plating solution as mentioned above are introduced into the cathode compartment. Then, the second electrolysis is conducted for 180 hours under the same conditions as in the first electrolysis. In this case, the iron hydroxide and iron oxide residues deposited in the cathode compartment after the first electrolysis are allowed to stand as such during the second electrolysis. The solution obtained in the anode compartment after the second electrolysis contains 200 g./liter of chromic anhydride, 2.5 g./liter of iron and 0.3 g./liter of trivalent chromium. The solution is mixed with the solution obtained in the anode compartment by the first electrolysis and then adjusted in respect of the trivalent chromium content. Excellent plating can be obtained similar to that obtained by employing a fresh plating bath.

EXAMPLES 3 & 4

The sludge obtained by reducing and neutralizing the wash waste from chromium-plated articles is reacted with an exhausted chromium-plating solution. An appropriate volume of the filtrate of the reaction mixture obtained after completion of the reaction is added to the solution in the anode compartment for the first and/or second electrolysis of each of Examples 1 to 2 and subjected to electrolysis. The same excellent result as in Examples 1 and 2 is obtained.

On the other hand, an appropriate volume of the filtrate of the reaction mixture obtained by the incomplete reaction between said sludge with an exhausted chromium-plating solution is added into the cathode compartment for the first and/or second electrolysis of each of Examples 1 and 2 and subjected to electrolysis. The same excellent result as in Examples 1 and 2 is obtained.

What is claimed is:

1. A process for treating an exhausted iron-containing chromium-plating solution by two-stage diaphragm electrolysis to remove iron values contained in said exhausted chromium-plating solution and regenerate the solution, comprising the steps of conducting a first electrolysis with an accompanying electrodialysis of chromic acid values in a diaphragm electrolytic cell partitioned by a diphragm into an anode compartment containing a diluted aqueous chromic acid solution and a cathode compartment containing an exhausted chromium-plating solution; interrupting said first electrolysis when the chromic acid concentration in the anode compartment reaches a predetermined level due to the transfer and extraction of the chromic acid values in the cathode compartment into the anode compartment by the electrodialysis while iron values precipitate in the cathode compartment; withdrawing for use as a chromium-plating bath the solution obtained in the anode compartment; transferring the obtained solution in said cathode compartment into said anode compartment; charging said cathode compartment with an exhausted chromium plating solution; and conducting a second electrolysis to effect the electrolytic oxidation in said anode compartment and to effect the electrodialysis of the chromic acid values in said cathode compartment to transfer and extract the chromic acid values into said anode compartment while the iron values precipitate in the cathode compartment as the hydroxide, thereby increasing the chromic acid concentration in said anode compartment to a predetermined level.

2. A process for treating an exhausted iron-containing chromium-plating solution by two-stage diaphragm electrolysis to remove iron values contained in said exhausted chromium-plating solution and regenerate the solution, comprising the steps of conducting a first electrolysis with an accompanying electrodialysis of chromic acid values in a diaphragm electrolytic cell partitioned by a diaphragm into an anode compartment containing a diluted aqueous solution of exhausted chromium-plating solution obtained by diluting the exhausted-plating solution with water and a cathode compartment containing an exhausted chromium-plating solution; interrupting said first electrolysis when the chromic acid concentration in the anode compartment reaches a predetermined level due to the transfer and extraction of the chromic acid values in the cathode compartment into the anode compartment by the electrodialysis while iron values precipitate in the cathode compartment; withdrawing for use as a chromium-plating bath the solution obtained in the anode compartment; transferring the obtained solution in said cathode compartment into said anode compartment; charging said cathode compartment with an exhausted chromium plating solution; and conducting a second electrolysis to effect the electrolytic oxidation in said anode compartment and to effect the electrodialysis of the chromic acid values in said cathode compartment to transfer and extract the chromic acid values into said anode compartment while the iron values precipitate in the cathode compartment as the hydroxide, thereby increasing the chromic acid concentration in said anode compartment to a predetermined level.

3. A process as claimed in claim 1 wherein an aqueous chromium chromate complex solution which is free of iron value and is obtained by a complete reaction between an exhausted chromium-plating solution and a sludge which includes mainly chromium hydroxide and is obtained by reducing and neutralizing a diluted chromium-plating waste liquor is added to the solution in the anode compartment for at least one of the first electrolysis and the second electrolysis; and a reaction mixture which includes chromim chromate complex and iron values and is obtained by an incomplete reaction between an exhausted chromium-plating solution and a sludge which includes mainly chromium hydroxide and is obtained by reducing and neutralizing a diluted chromium-plating waste liquor is added to the solution in the cathode compartment for at least one of the first electrolysis and the second electrolysis.

4. A process as claimed in claim 2 wherein an aqueous chromium chromate complex solution which is free of iron value and is obtained by a complete reaction between an exhausted chromium-plating solution and a sludge which includes mainly chromium hydroxide and is obtained by reducing and neutralizing a diluted chromium-plating waste liquor is added to the solution in the anode compartment for at least one of the first electrolysis and the second electrolysis; and a reaction mixture which includes chromium chromate complex and iron values and is obtained by an incomplete reaction between an exhausted chromium-plating solution and a sludge which includes mainly chromium-plating solution and a sludge which includes mainly chromium hydroxide and is obtained by reducing and neutralizing a diluted chromium-plating waste liquor is added to the solution in the cathode compartment for at least one of the first electrolysis and the second electrolysis.

5. A process as claimed in claim 1 wherein said exhausted iron containing chromium-plating solution has a sulfuric acid content of about 2.5 grams per liter.

* * * * *